US006508732B1

(12) United States Patent
Romberger et al.

(10) Patent No.: US 6,508,732 B1
(45) Date of Patent: Jan. 21, 2003

(54) TENNIS BALL

(76) Inventors: Mildred Kinghorn Romberger, 6315 Forbes Ave., Box 504, Pittsburgh, PA (US) 15217; Penny Rose Abrams, 135 S. Dallas Ave., Pittsburgh, PA (US) 15208

( * ) Notice: Subject to any disclaimer, the term of this patent is extended or adjusted under 35 U.S.C. 154(b) by 0 days.

(21) Appl. No.: 09/896,483

(22) Filed: Jun. 29, 2001

Related U.S. Application Data

(60) Provisional application No. 60/215,841, filed on Jul. 3, 2000.

(51) Int. Cl.[7] ..... A63B 39/06
(52) U.S. Cl. ..... 473/606; 273/DIG. 24
(58) Field of Search ..... 473/606, 604, 473/600, 598, 607, 570; 273/DIG. 24

(56) References Cited

U.S. PATENT DOCUMENTS 716,645 A * 12/1902 Ransom ..... 273/DIG. 24
3,025,587 A * 3/1962 Seidel ..... 273/DIG. 24
3,445,551 A * 5/1969 Griffin ..... 273/DIG. 24
3,703,292 A * 11/1972 Starr ..... 273/DIG. 24
3,971,560 A * 7/1976 Panosh ..... 273/DIG. 24
4,739,989 A 4/1988 Prinz et al.
5,174,571 A * 12/1992 Augusson et al. ... 273/DIG. 24
5,211,788 A * 5/1993 Song ..... 473/606
5,321,069 A 6/1994 Owens
5,403,000 A * 4/1995 Woosley ..... 273/DIG. 24
5,417,438 A * 5/1995 Poff ..... 273/DIG. 24
5,603,497 A * 2/1997 Louez ..... 473/606
5,830,092 A 11/1998 Meeks
5,836,261 A * 11/1998 Sutton ..... 116/209

OTHER PUBLICATIONS

United Mineral and Chemical Corporation Literature, Date Unknown.
Afterglow International Fibers, LLC Literature, Date Unknown.

* cited by examiner

*Primary Examiner*—Steven Wong
(74) *Attorney, Agent, or Firm*—Webb Ziesenheim Logsdon Orkin & Hanson, P.C.

(57) ABSTRACT

The present invention is a tennis ball that includes an outer fabric cover that has a phosphorescent component.

8 Claims, 2 Drawing Sheets

TENNIS BALL

CROSS REFERENCE TO RELATED APPLICATION

This application claims the benefit of U.S. Provisional Application Serial No. 60/215,841, filed Jul. 3, 2000, which is hereby incorporated by reference.

FIELD OF THE INVENTION

This invention relates to standard tennis balls.

DESCRIPTION OF THE PRIOR ART

A tennis ball consists generally of a spherical rubber core covered with a cloth having a felt surface. The surface of the felt offers wind resistance in flight and frictional contact with a tennis racket, so that the path of the ball can be controlled. Without this control, the game cannot be played satisfactorily.

The fabric felt is very important not only to the play performance of the tennis ball, but also to the cosmetic quality of the finished ball. If the fabric is properly engineered, it can meet all of the needs of the ball manufacturer which is a specific play characteristic for each level of player and court surface, as well as a ball relatively free from cosmetic defects, such as seam cracks, ghosting of edge adhesive, puckers, lumps, overlaps, irregular seams and visible 3rd cure rings after fluffing. A traditional method of making tennis felt covers has been with yarn and woven technologies subsequently napped and finished. An alternative technology has been the needle punch technology, whereby fibers oriented in layers from a non-woven cord and subsequently needled to entangle the fibers with or without a scrim for support. This fabric may or may not then be finished to try to make it more soft and conducive to covering a spherical core.

Presently, tennis balls have specific bounds, size and deformation qualities. Typically, tennis is played with a regulation tennis ball that can be white, yellow or pastel in color. In well lit conditions, the ball can easily be seen during play. Some outdoor tennis courts have lighting that permit play well into the evening. However, many courts do not include this lighting or the lighting is inadequate for good visibility. Therefore, the tennis ball becomes difficult to see at dusk or low light conditions, such as extremely cloudy weather.

Therefore, it is an object of our invention to provide a tennis ball for use in low light conditions.

SUMMARY OF THE INVENTION

The present invention is a tennis ball that is adapted to improve visibility of the ball in low light level conditions. Specifically, the ball includes a standard core having a felt-like material attached thereto. The felt-like material is preferably made of a woven wool material having luminescent fabric threads contained therein. The ball will have a glow-in-the-dark appearance for low level light conditions, that is, the ball will emit light. More specifically, our invention is a tennis ball having a core and luminescent fabric cover on its outer surface. The fabric may include a felt material of a synthetic and wool material. The synthetic portion of the felt has a phosphorescent component. The present invention is also a game incorporating the ball where a tennis court is provided having lines that include glow-in-the-dark pigment. Also, a tennis net and tennis racquets may be provided having glow-in-the-dark components.

DESCRIPTION OF THE PREFERRED EMBODIMENT

The art of manufacturing tennis balls has been well developed heretofore by such companies Dunlop Rubber Co. Ltd. of London, England and Wilson Sporting Goods of Chicago, Ill. (See also U.S. Pat. Nos. 5,830,092 and 4,739,989 which are hereby incorporated by reference.) The manufacture of fabric covers for tennis balls generally includes the stamping of "dumbbell" shapes and a pair of these shapes being applied to a vulcanized core. Prior to stamping the dumbbells, the fabric and cores are coated with a compatible adhesive and presented to a "3rd curing" operation after a stack of dumbbells have been dipped with an edge adhesive and individually applied to the core. After this heat curing step, a ball is formed with wide seams separating a pair of dumbbells, but are left with a circular ring from a point which the two halves of the press come together and trap fiber. This is known in the industry as a 3rd curing ring and must subsequently be removed by a process where live steam is presented to the balls for an extended period of time. The present invention can be made by this process.

Figure 1:
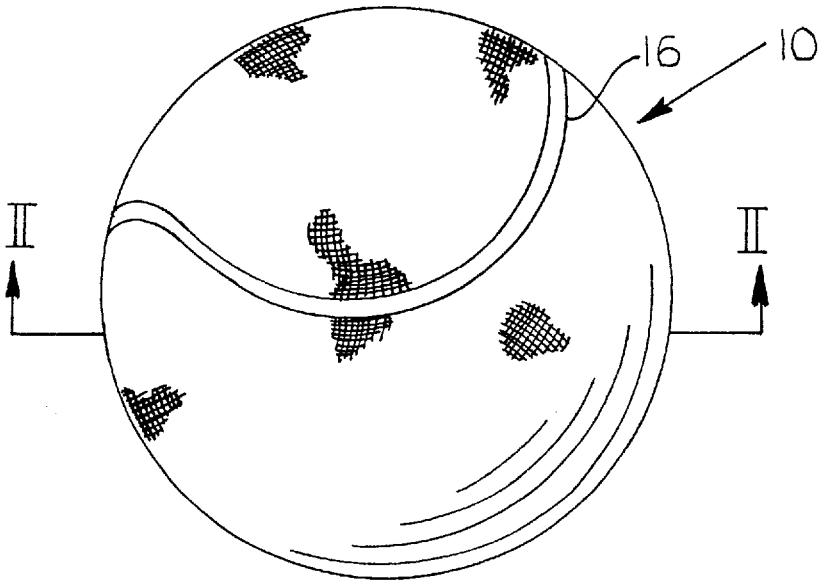
FIG. 1 shows a perspective view of a tennis ball made in accordance with the present invention.
Figure 2:
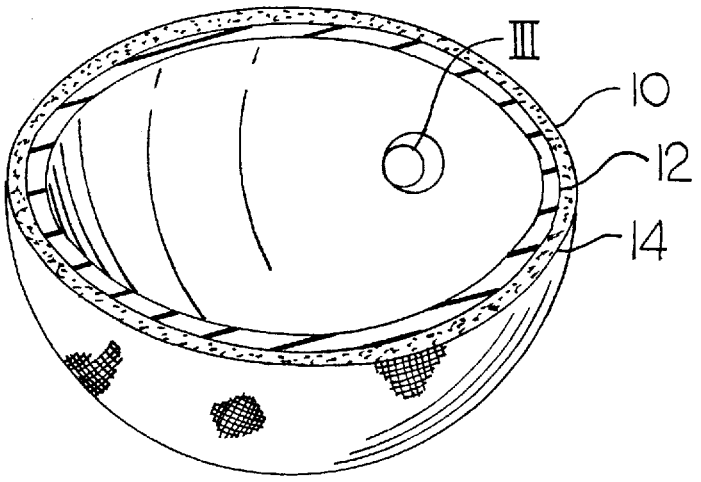
FIG. 2 is a section taken along lines II—II in FIG. 1.
Figure 3:
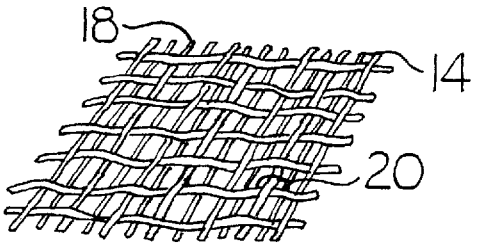
FIG. 3 is an enlarged portion of III shown in FIG. 2.

FIG. 1 shows a spherical tennis ball 10 made in accordance with the present invention. FIG. 2 is a perspective view of one-half of the tennis ball 10 taken along section II—II. The tennis ball 10 includes a shell 12 made of vulcanized rubber material. A felt layer 14 is glued thereon. A cord-like rubber bond 16 is formed between two tong-like felt portions.

Each felt portion is made of a woven fabric material that includes yarn made of wool 18 and yarn made from a polymeric synthetic material 20, such as a nylon yarn. Preferably, the nylon yarn has a phosphorescent pigment impregnated in the nylon fibers that make up the nylon yarn, which permits the yarn to glow in the dark. One such glow-in-the-dark yarn is provided by Afterglow International Fibers, LAC, P.O. Drawer 1507, Chats worth, Ga. 30705 and sold under the trademark "Afterglow Phosphorescent Fiber", which is described in U.S. Pat. No. 5,321,069, which is hereby incorporated by reference. Since the phosphorescent pigment is impregnated into the nylon fiber, it cannot be worn out, washed out or bleached out of the fiber. The phosphorescent pigment absorbs light from any source available and releases light (glows) in the darkness or low light level conditions, such as cloudy days or in shaded tennis courts. The nylon fiber provided by Afterglow International Fibers glows for 3–10 hours depending on the type and amount of pigment used. This is a preferable range. The fiber is available in a range from 250–2600 deniers in B.C.F. Yarn and can be either nylon or polypropylene. It is believed that glow-in-the-dark yarn made of polypropylene, or other polymeric material is impregnated with a phosphorescent pigment.

In operation, preferably, the balls 10 should be placed first in a well lit area for approximately twenty minutes to thirty minutes. The balls 10 can then be used to play tennis in low level light conditions. Preferably, a maximum amount of phosphorescent material should be used with the nylon thread, i.e., 10% of total weight such as 325 denier Nylon Airjet Textured, 650 denier Nylon Airjet Textured, 1000 denier Nylon Airjet Textured, 1300 denier Nylon Airtac, 2000 denier Airtac, and 2600 denier Nylon Airtac supplied by Afterglow International Fibers, LLC. It is believed that these fibers use the pigment LumiNova® supplied by United Mineral and Chemical Corporation, although other percentage amounts of phosphorescent material may be used. The density and amount of phosphorescent yarn used with the wool yarn to form the outer cover is determined on a case-by-case basis, depending on the amount of glow effect needed to see the ball. It is important to note that the phosphorescent yarn fibers be placed close to the outer surface of the ball to gain maximum effect of the phosphorescent.

The present invention overcomes the problem of visibility of the tennis ball in low level light conditions. Further, the phosphorescent yarn does not detrimentally affect the ball as would a coating to the ball with a material to achieve the glow-in-the-dark effect. Furthermore, since the pigment is impregnated in the phosphorescent fiber, the glow-in-the-dark effect will not be degraded as the ball is in play as would the case if a glow-in-the-dark coating, like paint, is applied to the outer surface of this fiber.

The present tennis ball can be used in other situations not limited to playing the game of tennis. Specifically, the tennis ball could be attached to an antennae of a car for identification in low light level conditions as well as placed on a walker or wheelchair so that the wheelchair may be seen in low light level conditions. Also, the ball can be used as a ball to throw or play baseball with and/or as a pet toy.

Figure 4:
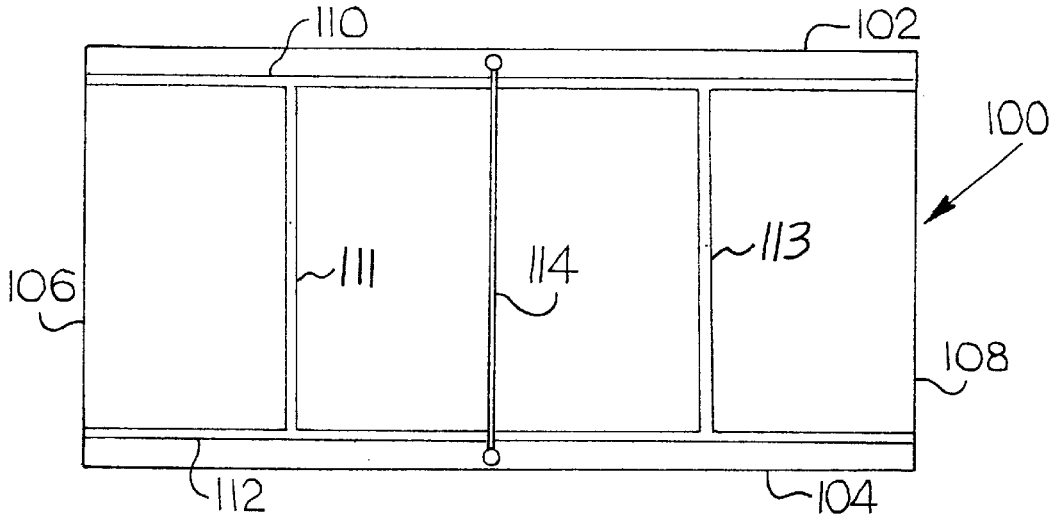
FIG. 4 is a top plan view of a tennis court made in accordance with the present invention.
Figure 5:
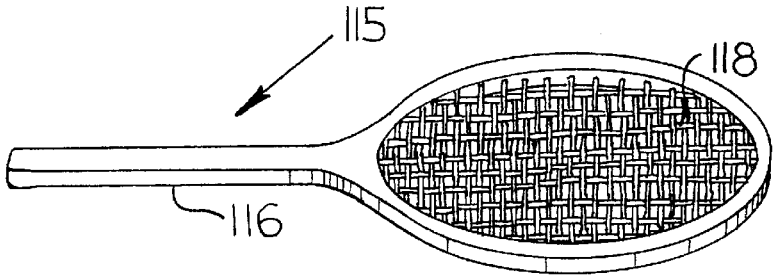
FIG. 5 is a top plan view of a tennis racquet made in accordance with the present invention.
Figure 6:
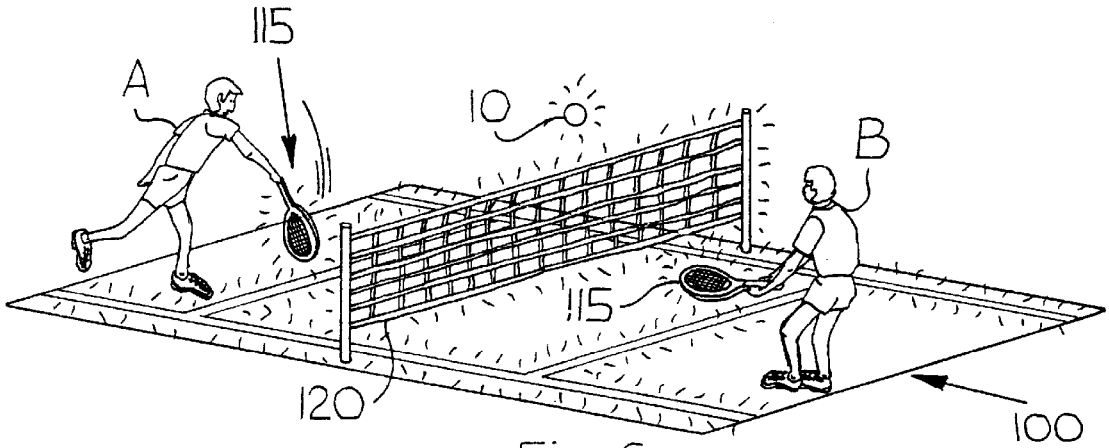
FIG. 6 is a top perspective view of a tennis court with individuals playing a game of tennis made in accordance with the present invention.

Referring to FIGS. 4–6, there is shown another embodiment of the present invention, namely, a tennis court, tennis racquet, and tennis game that incorporates the above-described tennis ball 10. FIG. 4 shows a tennis court 100, having lines 102, 104, 106, 108, 110, 111, 112, and 113, which define the court 100. The court lines 102, 104, 106, 108, 110, 111, 112, and 113 are painted or attached to a substrate such as asphalt and include a glow-in-the-dark component. That component can include pigment such as, for example, the previously described LumiNova® pigment. This pigment permits the above-identified court lines to glow in the dark or glow in a low level light condition. The court also includes a tennis net 114, which also includes netting 120, as shown in FIG. 6, which can be made of a glow-in-the-dark fiber previously described and manufactured by Afterglow International Fibers, LLC. FIG. 5 shows a tennis racquet 115 which includes a handle 116 and strings 118. The handle 116 and the strings 118 may also include a glow-in-the-dark pigment and/or fiber as previously described. FIG. 6 shows two individuals A and B playing on the court 100 using racquets 115 and ball 10. All of the racquets 115, the netting 120, and court lines 102, 104, 106, 108, 110, 111, 112, and 113 include the glow-in-the-dark component as described above. Hence, the tennis game can be played in low light level conditions without the necessity of separate electric lights. Particularly, the present invention is useful when individuals are playing later in the day or prior to dusk. As dusk approaches, the tennis court lines 102, 104, 106, 108, 110, 111, 112, and 113 the netting 120, and the racquets 115 will glow in the dark along with ball 10. This will permit the players A and B to play tennis longer than had the ball, net, and court not included the glow-in-the-dark component. In another variation of the game, it is possible to include a black light where lighting is available and provide appropriate pigments which will "glow-in-the-dark" under the black light conditions. However, this would be a game more suited as a novelty item as opposed to regular tennis. Preferably, the present invention does not require the assistance of other exterior lighting for the ball to glow in the dark during play. Other lighting sources may be used prior to that time to enable the ball to glow in the dark during play. The same is true for the tennis racquet, tennis net, and tennis court lines.

Having described the presently preferred embodiments of our invention, it is to be understood that it may otherwise be embodied within the scope of the appended claims.

We claim:

1. A ball, comprising:

a shell of elastic material enclosing an interior space; and a layer of substantially felt-like material applied to the outer surface of the shell, wherein the layer glows in the dark, wherein the felt-like material is a woven material that comprises a polymeric material that has a phosphorescent component that glows in the dark impregnated in the polymeric material, wherein the polymeric material comprises yarn made of polymeric fibers.

2. A ball as claimed in claim 1, wherein the polymeric material comprises one of nylon and polypropylene.

3. A ball as claimed in claim 2, wherein the felt-like material comprises a blend of yarn made of wool and said polymeric yarn.

4. A ball as claimed in claim 1, wherein said ball is a tennis ball.

5. A game comprising:

(a) a tennis court having tennis court lines;

(b) a racquet;

(c) a tennis net; and (d) a tennis ball that includes a shell of elastic material enclosing an interior space and a layer of substantially felt-like material applied to the outer surface of the shell, wherein the layer glows in the dark, wherein the felt-like material is a woven material that comprises a polymeric material that has a phosphorescent component that glows in the dark impregnated in the polymeric material, wherein the polymeric material comprises yarn made of polymeric fibers, and wherein at least the one of the tennis court, the racquet, and the tennis net comprises a phosphorescent material that glows in the dark.

6. A game as claimed in claim 5, wherein the polymeric material comprises one of nylon and polypropylene.

7. A game as claimed in claim 6, wherein the felt-like material comprises a blend of yarn made of wool and said polymeric yarn.

8. A method for playing a game of tennis, comprising the steps of:

providing a tennis court having tennis court lines, a racquet, a tennis net wherein at least one of said tennis court lines, tennis racquet, and tennis net comprises phosphorescent material that glows in the dark; and a tennis ball that includes a shell of elastic material enclosing an interior space and a layer of substantially felt-like material applied to the outer surface of the shell, wherein the layer glows in the dark, wherein the felt-like material is a woven material that comprises a polymeric material that has a phosphorescent component that glows in the dark impregnated in the polymeric material, wherein the polymeric material comprises yarn made of fibers, providing light to supply light energy to be stored in the phosphorescent compound in the court lines, tennis racquet, net, and tennis ball;

providing two players positioned on opposite sides of the net;

hitting the ball from one player to the other over the net;

providing a low light condition to the court lines, net, tennis racquet, and tennis ball; and emitting light from a phosphorescent compound in at least one of the tennis court lines, the tennis net, and the racquet, and the tennis ball whereby the players can continue to play tennis in a low light condition without the aid of additional artificial lighting on the court.

* * * * *